US009270051B1

(12) United States Patent
Christiansen et al.

(10) Patent No.: US 9,270,051 B1
(45) Date of Patent: Feb. 23, 2016

(54) WET MATE CONNECTOR

(71) Applicant: Ametek SCP, Inc., Westerly, RI (US)

(72) Inventors: Matt Christiansen, Westerly, RI (US); Greg Marshall, Westerly, RI (US); Richard Miller, Franklin, MA (US)

( * ) Notice: Subject to any disclaimer, the term of this patent is extended or adjusted under 35 U.S.C. 154(b) by 0 days.

(21) Appl. No.: 14/477,094

(22) Filed: Sep. 4, 2014

(51) Int. Cl.
*H01R 13/523* (2006.01)
*H01R 13/52* (2006.01)
*H01R 24/58* (2011.01)

(52) U.S. Cl.
CPC ..... *H01R 13/523* (2013.01); *H01R 13/5219* (2013.01); *H01R 24/58* (2013.01)

(58) Field of Classification Search
CPC ..... H01R 13/523
See application file for complete search history.

(56) References Cited

U.S. PATENT DOCUMENTS 4,373,767 A * 2/1983 Cairns ..... H01R 13/523 439/199
4,411,491 A * 10/1983 Larkin ..... H01R 13/523 385/59
4,589,717 A * 5/1986 Pottier ..... H01R 13/523 439/140
4,606,603 A * 8/1986 Cairns ..... G02B 6/3816 174/70 R
4,666,242 A * 5/1987 Cairns ..... G02B 6/3816 385/69
4,682,848 A * 7/1987 Cairns ..... G02B 6/3816 385/69
4,767,349 A * 8/1988 Pottier ..... H01R 13/523 166/65.1
4,859,196 A * 8/1989 Durando ..... H01R 13/523 439/197
4,887,883 A * 12/1989 Darbut ..... G02B 6/3816 385/58
4,948,377 A * 8/1990 Cairns ..... H01R 13/523 439/200
5,007,852 A * 4/1991 Dean ..... H01R 13/523 439/201
5,131,464 A * 7/1992 Lenhart ..... E21B 7/04 166/65.1
5,171,158 A * 12/1992 Cairns ..... H01R 13/523 439/190
5,358,418 A * 10/1994 Carmichael ..... E21B 17/028 166/65.1
5,484,296 A * 1/1996 Taylor ..... H01R 13/523 439/140
5,645,438 A * 7/1997 Cairns ..... G02B 6/3816 439/139
5,645,442 A * 7/1997 Cairns ..... H01R 13/523 439/201
5,722,842 A * 3/1998 Cairns ..... G02B 6/3816 439/139

(Continued)

OTHER PUBLICATIONS

Jenkins et al., "Essential Design and Risk Management for a Next Generation Ocean Dry Mate Connector", Oceans-San Diego, IEEE, 2013.

*Primary Examiner* — Ross Gushi
(74) *Attorney, Agent, or Firm* — RatnerPrestia

(57) ABSTRACT

A wet mate electrical connector includes a female connector and a male connector. The female connector can include a female connector body defining a central passage. The central passage can include a plurality of female contacts. The male connector can include a male connector body defining a central passage. A male pin can project from the central passage of the male connector body. The male pin can include a plurality of male contacts and be insertible into the central passage of the female connector. The male connector can also include a sleeve slidably displaceable over the male pin between a first position in which the sleeve covers the plurality of male contacts in a protected condition, and a second position in which the sleeve is retracted and exposes the plurality of male contacts.

14 Claims, 6 Drawing Sheets

(56) References Cited

U.S. PATENT DOCUMENTS 5,738,535 A * 4/1998 Cairns ..... G02B 6/3816 439/138
5,772,457 A * 6/1998 Cairns ..... H01R 13/523 439/201
5,820,416 A * 10/1998 Carmichael ..... E21B 17/028 166/65.1
5,838,857 A * 11/1998 Niekrasz ..... H01R 13/523 385/56
5,967,816 A * 10/1999 Sampa ..... E21B 17/028 439/190
6,017,227 A * 1/2000 Cairns ..... G02B 6/3816 439/138
6,056,327 A 5/2000 Bouldin et al.
6,095,838 A * 8/2000 Brickett ..... H01R 13/523 439/201
6,315,461 B1 * 11/2001 Cairns ..... G02B 6/3816 385/139
6,332,787 B1 * 12/2001 Barlow ..... H01R 13/5227 439/138
6,439,932 B1 * 8/2002 Ripolone ..... E21B 17/028 439/668
6,464,405 B2 * 10/2002 Cairns ..... G02B 6/3816 385/139
6,511,335 B1 * 1/2003 Rayssiguier ..... H01R 13/523 385/56
6,736,545 B2 * 5/2004 Cairns ..... G02B 6/3816 174/74 R
6,832,924 B2 * 12/2004 Maletzki ..... H01R 13/523 439/201
6,902,414 B2 * 6/2005 Dopf ..... E21B 17/028 439/140
6,910,910 B2 * 6/2005 Cairns ..... G02B 6/3816 431/13
6,932,636 B2 * 8/2005 Abbey ..... H01R 13/629 439/138
7,004,638 B2 * 2/2006 Nicholson ..... G02B 6/3849 385/53
7,052,297 B2 * 5/2006 Panzar ..... H01R 13/187 439/169
7,074,064 B2 * 7/2006 Wallace ..... E21B 17/028 166/65.1
7,097,515 B2 * 8/2006 Siddiqi ..... H01R 13/523 439/700
7,112,080 B2 * 9/2006 Nicholson ..... E21B 17/023 439/283
7,244,132 B1 * 7/2007 Cairns ..... H01R 13/523 439/191
7,364,448 B2 * 4/2008 Cairns ..... G02B 6/3816 439/201
7,530,744 B2 * 5/2009 Prel ..... G02B 6/3816 385/111
7,845,966 B2 * 12/2010 Rioufreyt ..... H01R 13/5213 439/137
7,955,105 B2 * 6/2011 Maeland ..... H01R 13/523 439/191
7,959,454 B2 * 6/2011 Ramasubramanian H01R 13/03 439/201
8,186,202 B2 5/2012 Lafleur et al.
8,192,089 B2 * 6/2012 Cairns ..... G02B 6/3816 385/138
8,292,645 B2 * 10/2012 Cairns ..... H01R 13/523 439/271
8,376,765 B2 * 2/2013 Chaize ..... E21B 33/0385 439/201
8,485,837 B2 * 7/2013 Head ..... H01R 13/523 166/66
8,511,908 B2 * 8/2013 Cairns ..... G02B 6/3816 385/138
8,636,527 B2 * 1/2014 Hengel ..... B60L 11/1818 439/141
8,668,509 B2 * 3/2014 Chaize ..... E21B 33/0385 439/271
8,746,354 B2 * 6/2014 Head ..... E21B 17/028 166/381
8,816,196 B2 * 8/2014 Williams ..... E21B 33/04 174/11 R
8,816,197 B2 * 8/2014 Campbell ..... H01R 13/5205 174/11 R
8,900,000 B2 * 12/2014 Cairns ..... H01R 13/523 439/13
8,944,082 B2 * 2/2015 Cairns ..... F16L 29/005 137/1
9,028,264 B2 * 5/2015 Head ..... H01R 13/00 439/140
9,057,864 B2 * 6/2015 Kretschmar ..... G02B 6/506
9,077,099 B1 * 7/2015 Hatcher ..... G02B 6/3816
2005/0002617 A1 * 1/2005 Nicholson ..... G02B 6/3849 385/53
2005/0016769 A1 * 1/2005 Wallace ..... E21B 17/028 175/40
2005/0042903 A1 * 2/2005 Nicholson ..... E21B 17/023 439/201
2008/0299814 A1 * 12/2008 Rioufreyt ..... H01R 13/5213 439/367
2009/0080836 A1 * 3/2009 Cairns ..... G02B 6/3816 385/56
2011/0021049 A1 1/2011 Ramasubramanian et al.
2011/0306225 A1 * 12/2011 Chaize ..... E21B 33/0385 439/201
2014/0030904 A1 * 1/2014 Head ..... H01R 13/00 439/283
2015/0093921 A1 * 4/2015 Lewin ..... H01R 13/523 439/39
2015/0093931 A1 * 4/2015 Burrow ..... H01R 13/523 439/357

* cited by examiner

WET MATE CONNECTOR

FIELD

The field of the invention relates generally to wet mate connectors installed in downhole and deep sea environments, and more particularly to small-diameter wet mate connectors that incorporate seals, pressure balancing mechanisms, and electrical insulating mechanisms that allow the connectors to be used in permanent or long-term installations subject to high temperatures and pressures, where conventional wet mate connectors are not suited.

BACKGROUND

Hydraulic lines and conduits are used to provide power and data communications to equipment installed in wet environments like downhole and subsea environments. Electrical and fiber-optic cable connections must often be made deep in a well bore or at great ocean depths. Therefore, wet-mateable or "wet mate" connectors have been developed that allow equipment to be connected and disconnected in harsh wet environments.

A number of wet mate connectors feature a male end that includes a plug, and a female end that includes a socket to receive the plug. The plug and socket each include one or more electrical contacts. The electrical contacts must be protected from exposure to production fluid, seawater and contaminants during mating and disconnection of the male and female ends. In addition, interior spaces in the connector must be pressure balanced with the exterior environment so that the male and female ends can be mated and disconnected properly. Balancing interior and exterior pressure alleviates stresses on internal components and prevents components from becoming locked or jammed.

Some wet mate connectors include internal seals to protect electrical contacts. Nevertheless, many seals are designed for short-term use, and are not adequate to withstand harsh temperature and pressure conditions through repeated use in permanent or long-term installations. In addition, many connectors incorporate seals and other components for balancing pressures that occupy a relatively large amount of space, and are not small enough to be used in many well bores. In some well bores, less than an inch of space is allocated for the diameter of the connector. Unfortunately, conventional wet mate connectors cannot simply be made smaller. Even if they were to be reduced in size, they still cannot address the challenges of providing adequate pressure balancing and seal integrity, which are necessary in permanent or long-term installations subject to high temperatures and pressures.

SUMMARY

The drawbacks and limitations of conventional wet mate connectors are resolved in several respects by wet mate connectors in accordance with the invention.

In one embodiment, a wet mate electrical connector includes a female connector having a female connector body defining a female seal end and a central passage extending through the female connector body. The central passage includes a plurality of female contacts. The wet mate electrical connector also includes a male connector having a male connector body defining a male seal end and a central passage extending through the male connector body. A male pin axially projects from the central passage of the male connector body and features a plurality of male contacts. The male pin is insertible into the central passage of the female connector.

The male connector also has a sleeve slidably displaceable over the male pin between a first position in which the sleeve covers the plurality of male contacts in a protected condition, and a second position in which the sleeve is retracted and exposes the plurality of male contacts. Upon insertion of the male pin into the central passage of the female connector, the sleeve on the male pin contacts the female seal end to displace the sleeve from the first position to the second position to expose the plurality of male contacts. The plurality of male contacts axially align with the plurality of female contacts in the female connector when the male pin is fully inserted or substantially inserted into the central passage of the female connector.

The sleeve can define a sealed space around the plurality of male contacts when the sleeve is in the first position. In addition, the sealed space can be in fluid communication with a source of oil. The source of oil can distribute oil over the male contacts to protect the male contacts when the sleeve is in the first position.

The female connector can include a female pin axially displaceable in the central passage of the female connector body. The female pin can be displaced between a first position in which the female pin is generally adjacent the female seal end and a second position in which the female pin is displaced into the female connector body away from the female seal end. The female connector can also include a female biasing element that biases the female pin toward the first position. In addition, the central passage and female pin of the female connector can be filled with oil to protect the plurality of female contacts when the female connector is in an unmated condition. The female pin can include at least one port in fluid communication with pressure balanced oil to balance pressure in the central passage of the female connector and prevent hydraulic lock.

The female connector can also include a primary seal and a secondary seal to protect the plurality of female contacts. The primary seal can feature a scraper seal at the female seal end. In addition, or as an alternative, the primary seal can include at least one spring energized seal along the central passage. Moreover, the primary seal can include a plurality of spring energized seals arranged in series along the central passage. In such an embodiment, the plurality of female contacts can be arranged in series with the plurality of spring energized seals along the central passage. In addition, each of the plurality of female contacts can be separated by another of the plurality of female contacts by one of the plurality of spring energized seals.

In embodiments that feature at least one spring energized seal, the at least one spring energized seal can include a body portion and an internal spring in the body portion. The body portion can be formed of polytetrafluoroethylene (PTFE). In addition, or as an alternative, the body portion can be formed of PEEK.

BRIEF DESCRIPTION OF THE DRAWING FIGURES

The foregoing summary and the following detailed description will be better understood in conjunction with the following drawing figures containing non-limiting embodiments and examples, of which:

DETAILED DESCRIPTION

Figure 1:
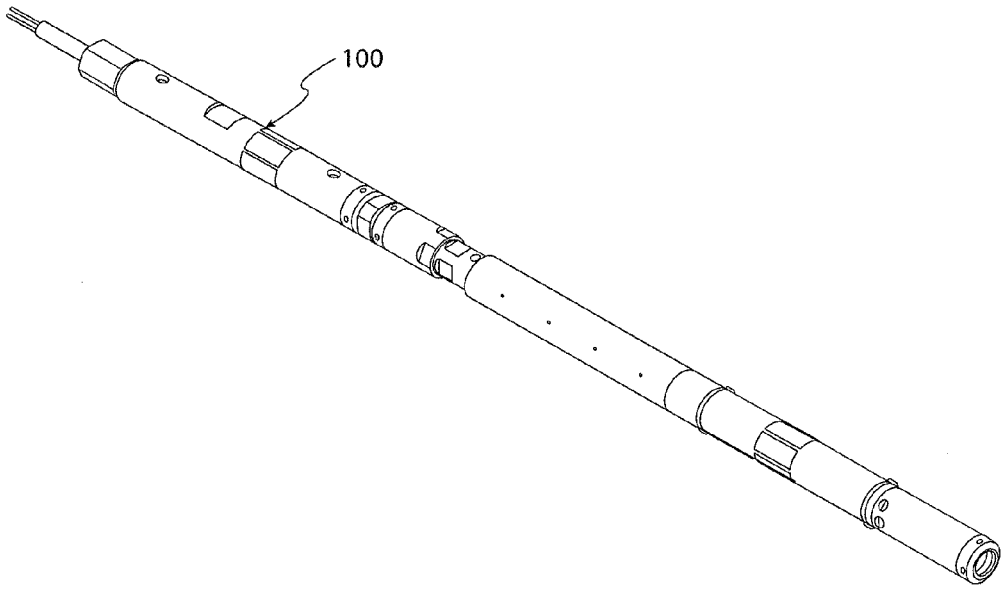
FIG. 1 is a perspective view of a female connector end of a wet mate connector in accordance with one embodiment.
Figure 2:
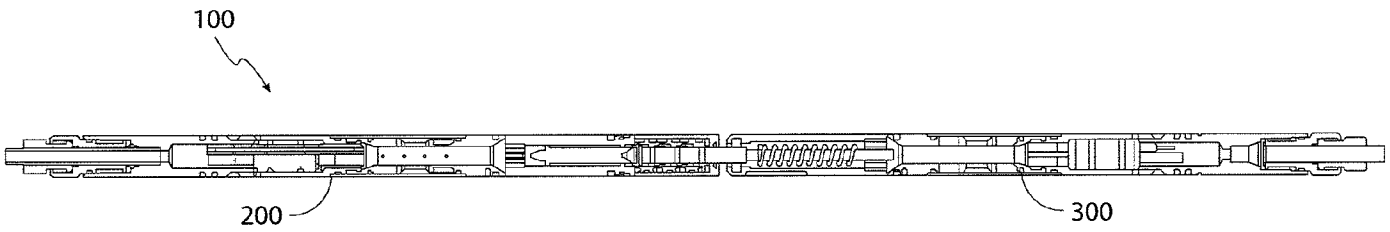
FIG. 2 is a side cross section view of a wet mate connector in accordance with one embodiment.
Figure 3:
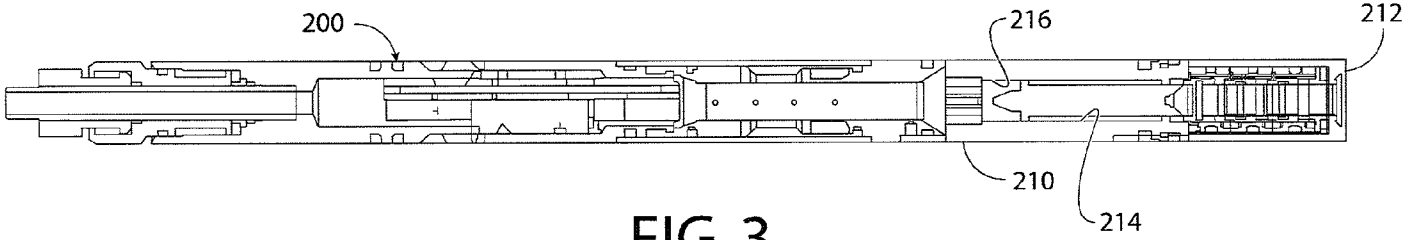
FIG. 3 is a side cross section view of a female connector end of the wet mate connector of FIG. 2.
Figure 4:
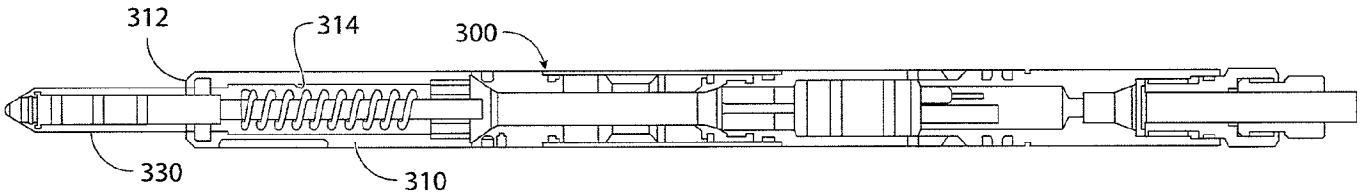
FIG. 4 is a side cross section view of a male connector end of the wet mate connector of FIG. 2.

Although the invention is illustrated and described herein with reference to specific embodiments, the invention is not intended to be limited to the details shown. Rather, various modifications may be made in the details within the scope and range of equivalents of the claims and without departing from the invention.

Referring to FIGS. 1-8, a wet mate electrical connector 100 is shown in accordance with one embodiment of the invention. Connector 100 incorporates seals, pressure balancing mechanisms, and electrical insulating mechanisms that allow the connector to be used in permanent or long-term installations subject to high temperatures and pressures, while occupying a cross sectional area less than one inch in diameter. As will be described, connector 100 provides pressure compensating oil over electrical contacts when the connector is mated and when the connector is unmated. Connector 100 also utilizes a ported arrangement to facilitate pressure balancing without the need for large-diameter components to provide pressure balancing. In addition, connector 100 utilizes secondary seals that do not experience compression set, enabling the connector to remain in service for the full life of a well bore or deep sea installation.

Connector 100 includes a female connector 200 and a male connector 300. Male connector 300 is configured to connect to female connector 200 in a quick-release connection. Female connector 200 includes a female connector body 210 having a female seal end 212. Female connector body 210 defines a central passage 214 that commences at female seal end 212 and extends through the female connector body. Central passage 214 forms a socket 216 that includes a plurality of female contacts 220 (seen best in FIGS. 5 and 6). A plurality of wires 270 pass through female connector 200 to each contact 220. Each wire 270 is electrically and hydraulically insulated by a plurality of O-rings 416, as will be explained.

Figure 5:
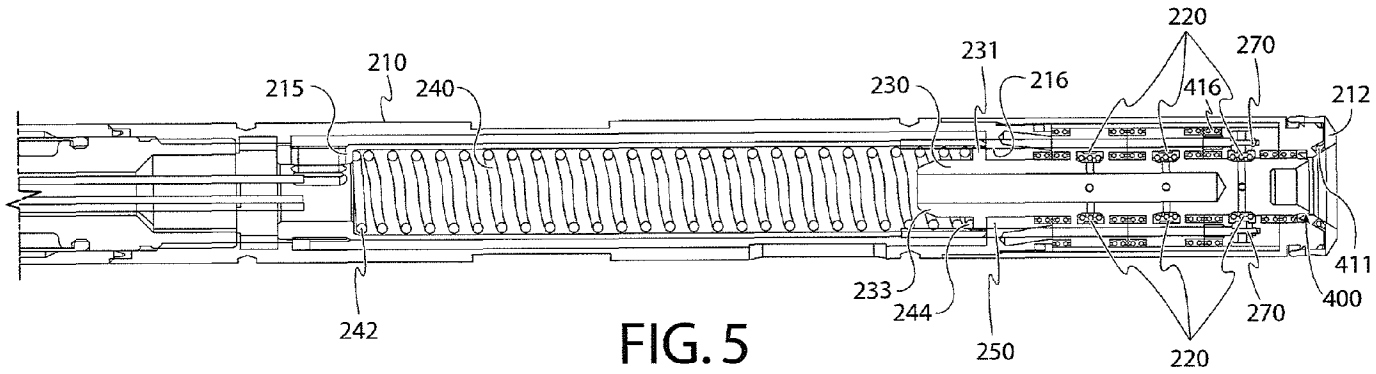
FIG. 5 is an enlarged truncated side cross section view of a portion of the female connector end of FIG. 3.
Figure 6:
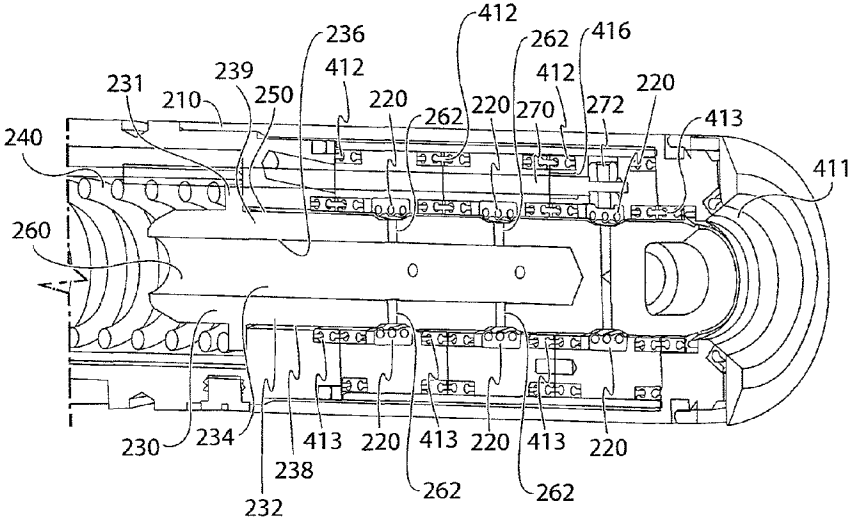
FIG. 6 is an enlarged truncated perspective view of an end portion of the female connector end of FIG. 3, shown in cross section.

Referring to FIGS. 5 and 6, female connector 200 includes a female pin 230 that is axially displaceable in central passage 214 of female connector body 210. Female pin 230 is displaceable between a first position, in which the female pin is adjacent female seal end 212, and a second position, in which the female pin is displaced into female connector body 210, away from the female seal end. Female connector 200 also includes a female biasing element in the form of a female spring 240. Female spring 240 is a helical compression spring that includes a first end 242 and a second end 244 opposite the first end. First end 242 engages a first wall 215 of central passage 214. Second end 244 engages female pin 230. Female pin 230 includes a flange 231 that extends radially outwardly from the pin near a first end 233 of the pin. Second end 244 of female spring 240 extends around first end 233 of female pin 230 and abuts flange 231. In this arrangement, female pin 230 and second end 244 of female spring 240 are axially displaceable together as a unit in central passage 214.

Female spring 240 is configured to store energy under compression when female pin 230 is displaced toward the second position. Female spring 240 is also configured to release energy and expand to displace female pin 230 toward the first position. In this configuration, female spring 240 biases female pin 230 toward the first position. When minimal or no resistance is applied to female spring 240, the female spring expands to displace female pin 230 to the first position, which closes female seal end 212 and hydraulically seals central passage 214 so that well bore fluid, seawater, sand and debris cannot enter the central passage.

Central passage 214 and female pin 230 are filled with oil 250. Oil 250 provides a controlled environment inside female connector body 210 that serves multiple purposes. First, oil 250 fills the spaces around female contacts 220 when the female connector is in an unmated condition to prevent entry of well bore fluid, seawater, sand and debris from entering. Entry of well bore fluid, seawater, sand or debris can damage the electrodes. Oil 250 also electrically insulates female contacts 220. Moreover, oil 250 allows the pressure inside female connector body 210 to be balanced with the pressure in the environment outside of connector 100. By balancing internal and external pressures, internal stresses on components in female connector body 210 caused by pressure differentials are minimized. This balancing of pressures prevents parts from binding, jamming, locking, or otherwise preventing the female connector 200 and male connector 300 from being connected or disconnected when needed.

Female connector body 210 includes a pressure balancing mechanism 260 integrated into female pin 230. In particular, female pin 230 includes ports 262 that pass through the female pin and connect in fluid communication with oil 250. Female pin 230 has a generally cylindrical body 232 defining a hollow central bore 234, an inner pin surface 236, an outer pin surface 238, and a pin wall 239. Each port 262 extends through pin wall 239, connecting an interior portion of female pin 230 with central passage 214 outside the female pin. Central passage 214 is pressure balanced by oil 250, so that the pressure inside female pin 230 and the pressure in the environment outside the connector are sufficiently balanced so that hydraulic lock between seals is prevented. Hydraulic lock can occur, for example, when female connector 200 and male connector 300 are connected in air, and air gets trapped between seals. Well bore pressure can act on oil 250, creating a pressure differential across seals. This pressure differential can hydraulically lock the position of female pin 230, preventing the female pin from moving and consequently preventing female connector 200 from connecting with the male connector 300.

Figure 7:
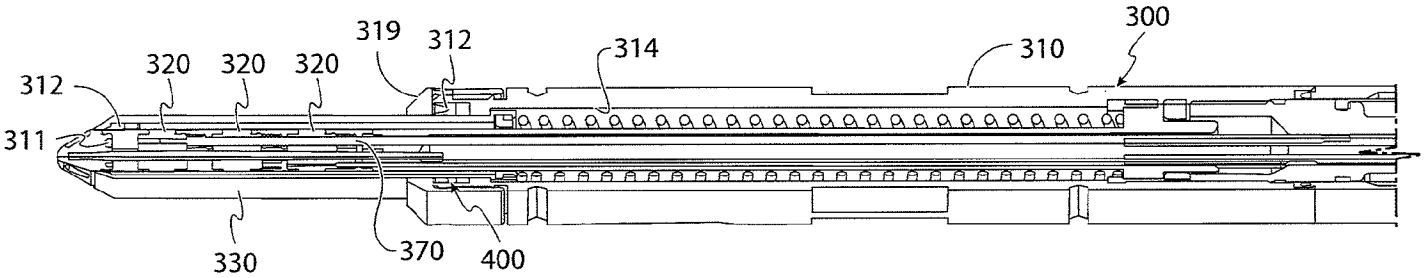
FIG. 7 is an enlarged truncated side cross section view of a portion of the male connector end of FIG. 4.
Figure 8:
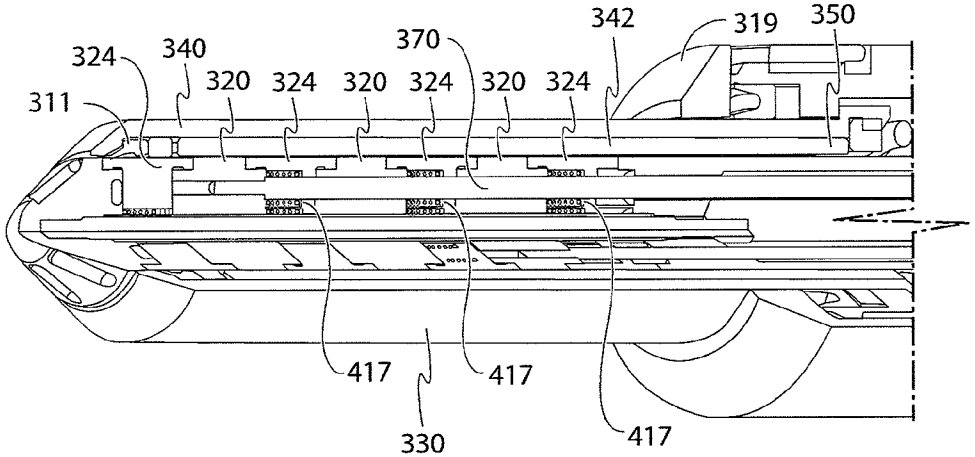
FIG. 8 is an enlarged truncated perspective view of an end portion of the male connector end of FIG. 4, shown in cross section.
Figure 9:
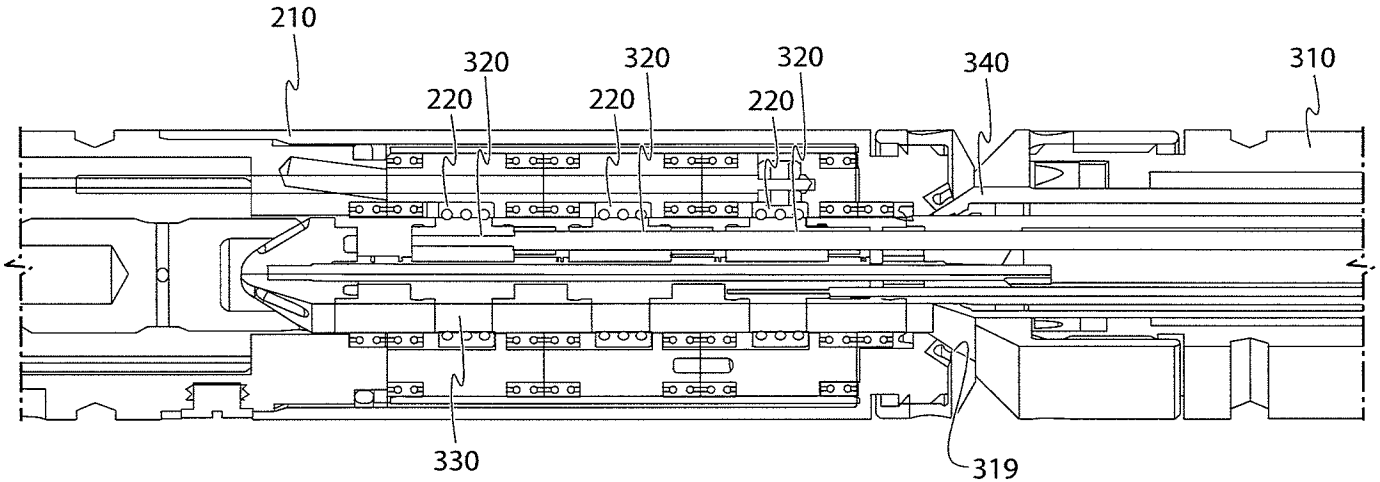
FIG. 9 is an enlarged truncated side cross section view of a portion of the wet mate connector of FIG. 2 in the mated condition.

Referring to FIGS. 7-9, male connector 300 includes a male connector body 310 defining a male seal end 319. Male connector body 310 defines a central passage 314 that commences at male seal end 319 and extends through the male connector body. Male connector 300 also includes a male pin 330 axially projecting from central passage 314.

Male pin 330 is insertible into central passage 214 of female connector 200, and includes a plurality of male contacts 320 arranged in series along the length of the male pin. A plurality of wires 370 pass through male connector 300 to each contact 320. Each wire 370 is electrically and hydraulically insulated, as will be explained. Each male contact 320 is separated from an adjacent male contact by an insulator 324 made of polyetheretherketone (PEEK). Female contacts 220 in female connector 200 are also separated by insulators made of PEEK.

To protect the plurality of male contacts 320, male pin 330 features a sleeve 340 that is displaceable over the male pin in a longitudinal direction of the pin. Sleeve 340 is displaceable between a first position, in which the sleeve covers male contacts 320 in a protected condition (FIG. 8), and a second position in which the sleeve is retracted and exposes the plurality of male contacts (FIG. 9). Upon insertion of male pin 330 into central passage 214 of female connector 200, sleeve 340 comes into contact with female seal end 212, which stops the sleeve from entering the central passage. As the rest of male pin 330 enters central passage 214 of female connector 200, sleeve 340 is displaced from the first position to the second position to expose the male contacts inside the central passage. Male contacts 320 align with female contacts 220 in female connector 200 when the male and female connectors are mated, as shown in FIG. 9.

Sleeve 340 defines a sealed space 342 around male contacts 320 when the sleeve is in the first position. Sealed space 342 is in fluid communication with a source of oil 350. The source of oil distributes oil 350 over male contacts 320 to protect the male contacts when male connector 300 is in an unmated condition, and when the sleeve is in the first position. Oil 350 fills sealed space 342 around male contacts 320 to prevent entry of well bore fluid, seawater, sand and debris from entering. Oil 350 also electrically insulates male contacts 320. Moreover, oil 350 allows the pressure inside male connector body 310 to be balanced with the pressure in the environment outside of connector 100. By balancing internal and external pressures, internal stresses on components in male connector body 310 caused by pressure differentials are minimized.

Male connector 200 and female connector 300 each feature a dual barrier mechanism 400 that lengthens the service life of the connector. Dual barrier mechanism 400 utilizes seals that are made of non-elastomeric materials, such as polytetrafluoroethylene (PTFE). As will be explained, many of the seals are reinforced so as to maintain their structural shape and integrity over periods of long-term exposure to high temperatures and pressures. This is a substantial departure from conventional wet mate connectors that typically use elastomeric seals. Elastomeric seals are prone to permanent deformation or "compression set" if they are exposed to high pressures and temperatures, causing the seals to fail, and making conventional wet mate connectors inadequate for permanent or long-term installation in well bores and deep sea environments.

Referring back to FIGS. 5 and 6, the dual barrier mechanism 400 in the female connector will be described. Dual barrier mechanism 400 includes a plurality of primary seals that can take various forms. For example, the primary seals in female connector 200 include, but are not limited to, a dynamic scraper or "nose" seal 411 at female seal end 212, static piston seals 412, and dynamic rod seals 413. Female contacts 220 are arranged in series with dynamic rod seals 413 along central passage 214, with each female contact being separated from another female contact by one of the dynamic rod seals. When female connector 200 is mated with male connector 300, dynamic rod seals 413 prevent or minimize channel to channel electrical losses.

Extreme pressures in well bores or deep sea installations can cause production fluid or seawater to enter a connector and replace some of the oil in the connector over long periods of service. Ingress of water can cause cavities and spaces around wires and contacts to become conductive. To prevent electrical issues from occurring, dual barrier mechanism 400 includes a plurality of secondary seals. Secondary seals allow the connector 100 to remain operative even when there is ingress of water in the connector that bypass the primary seals. Secondary seals include O-ring seals 416 around wires 270. O-ring seals 416 surround each wire 270 in proximity to where each wire terminates at each contact 220. These O-ring seals 416 electrically and hydraulically insulate the wires 270 to provide a secondary seal in the event that water enters into oil 250.

Referring back to FIGS. 7-9, the dual barrier mechanism 400 in the male connector 300 will be described. Primary seals in male connector 300 include, but are not limited to, a static "nose" face seal 311, a dynamic scraper seal 312 in sealed space 342, and a dynamic scraper seal 313 outside of sleeve 340. Secondary seals in male connector 300 include O-ring seals 417 around wires 370, similar to the O-ring seals 416 around wires 270 in female connector 200.

Primary and secondary seals in accordance with the invention preferably include at least some seals that are spring energized. Spring energized seals in accordance with the invention are reinforced internally so that they resist or prevent compression set. Each spring energized seal can have a unique body configuration to seal a specific area inside the male or female connector. In female connector 200, static piston seals 412 and dynamic rod seals 413 are spring energized seals. In male connector 300, dynamic scraper seal 312 and dynamic scraper seal 313 are spring energized seals.

Figure 10:
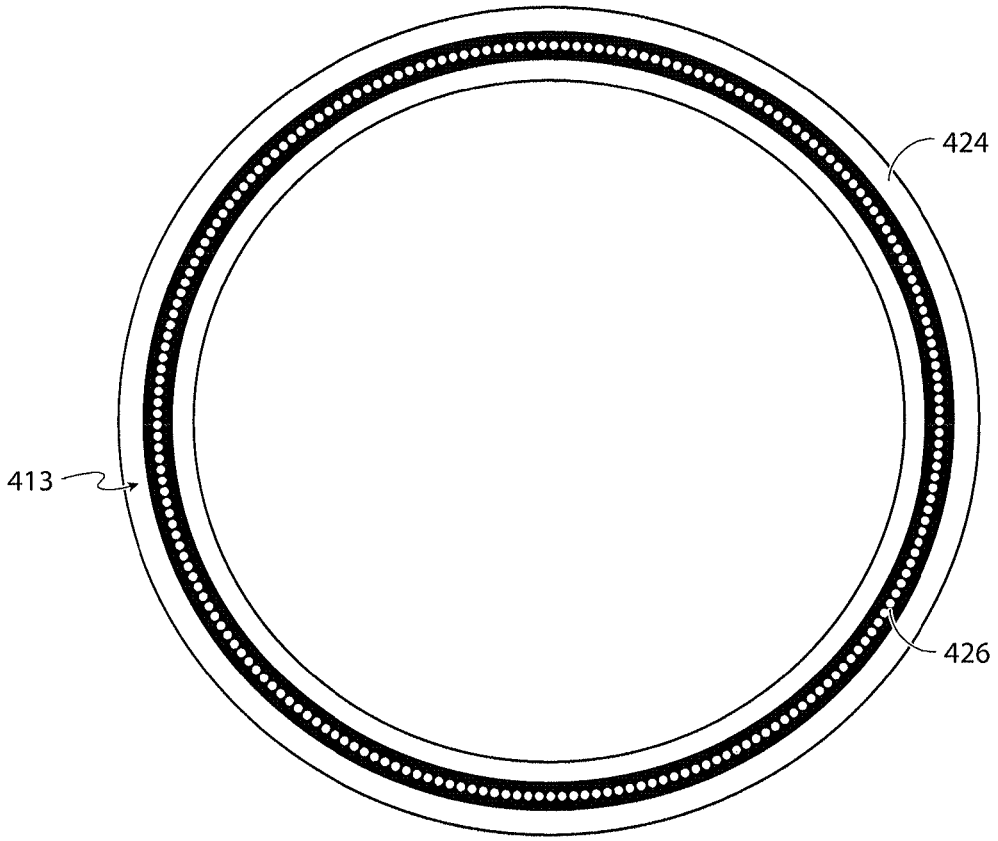
FIG. 10 is a plan view of a seal used in the wet mate connector of FIG. 1.
Figure 11:
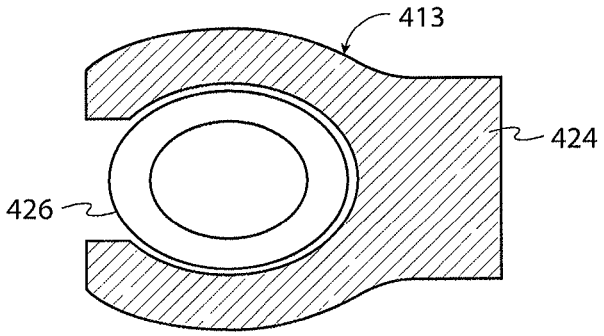
FIG. 11 is a side cross section view of the seal in FIG. 9.

Referring to FIGS. 10 and 11, one of the dynamic rod seals 413 is shown in more detail to illustrate the components of the spring energized seal. Dynamic rod seal 413 has a C-shaped jacket or body portion 424, and an internal spring 426 inside the body portion. Body portion 424 can be formed of polytetrafluoroethylene (PTFE) or PEEK. Spring 426 is a canted coil spring. During operation, spring 426 provides reinforcement to dynamic rod seal 413 to maintain the seal's structural shape and integrity over periods of short or long-term exposure to high temperatures and pressures, thereby resisting compression set. Unlike elastomeric seals, spring 426 is sufficiently energized and resilient so that when the seal is deformed, the spring can restore the seal to its original shape as pressure around the seal drops.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A wet mate electrical connector comprising:

A. a female connector comprising a female connector body defining a female seal end and a central passage extending through the female connector body, the central passage comprising a plurality of female contacts; and B. a male connector comprising:

i. a male connector body defining a male seal end and a central passage extending through the male connector body;

ii. a male pin axially projecting from the central passage of the male connector body, the male pin comprising a plurality of male contacts, the male pin being insertible into the central passage of the female connector; and iii. a sleeve slidably displaceable over the male pin between a first position in which the sleeve covers the plurality of male contacts in a protected condition, and a second position in which the sleeve is retracted and exposes the plurality of male contacts, wherein, upon insertion of the male pin into the central passage of the female connector, the sleeve on the male pin contacts the female seal end to displace the sleeve from the first position to the second position to expose the plurality of male contacts, the plurality of male contacts axially aligning with the plurality of female contacts in the female connector when the male pin is fully inserted or substantially inserted into the central passage of the female connector, wherein the sleeve defines a sealed space around the plurality of male contacts when the sleeve is in the first position, and wherein the sealed space is in fluid communication with a source of oil, the source of oil distributing oil over the male contacts to protect the male contacts when the sleeve is in the first position.

2. The wet mate electrical connector of claim 1, wherein the female connector comprises a female pin axially displaceable in the central passage of the female connector body between a first position in which the female pin is generally adjacent the female seal end and a second position in which the female pin is displaced into the female connector body away from the female seal end.

3. The wet mate electrical connector of claim 2, wherein the female connector comprises a female biasing element that biases the female pin toward the first position.

4. The wet mate electrical connector of claim 1, wherein the female connector comprises a primary seal and a secondary seal to protect the plurality of female contacts.

5. The wet mate electrical connector of claim 4, wherein the primary seal comprises a scraper seal at the female seal end.

6. The wet mate electrical connector of claim 4, wherein the primary seal comprises at least one spring energized seal along the central passage.

7. The wet mate electrical connector of claim 6, wherein the at least one spring energized seal comprises a body portion and an internal spring in the body portion.

8. The wet mate electrical connector of claim 7, wherein the body portion is formed of polytetrafluoroethylene (PTFE).

9. The wet mate electrical connector of claim 7, wherein the body portion is formed of PEEK.

10. A wet mate electrical connector comprising:

A. a female connector comprising a female connector body defining a female seal end and a central passage extending through the female connector body, the central passage comprising a plurality of female contacts; and B. a male connector comprising:

i. a male connector body defining a male seal end and a central passage extending through the male connector body;

ii. a male pin axially projecting from the central passage of the male connector body, the male pin comprising a plurality of male contacts, the male pin being insertible into the central passage of the female connector; and iii. a sleeve slidably displaceable over the male pin between a first position in which the sleeve covers the plurality of male contacts in a protected condition, and a second position in which the sleeve is retracted and exposes the plurality of male contacts, wherein, upon insertion of the male pin into the central passage of the female connector, the sleeve on the male pin contacts the female seal end to displace the sleeve from the first position to the second position to expose the plurality of male contacts, the plurality of male contacts axially aligning with the plurality of female contacts in the female connector when the male pin is fully inserted or substantially inserted into the central passage of the female connector, wherein the female connector comprises a female pin axially displaceable in the central passage of the female connector body between a first position in which the female pin is generally adjacent the female seal end and a second position in which the female pin is displaced into the female connector body away from the female seal end, and wherein the central passage and female pin of the female connector are filled with oil to protect the plurality of female contacts when the female connector is in an unmated condition.

11. The wet mate electrical connector of claim 10, wherein the female pin comprises at least one port in fluid communication with pressure balanced oil to balance pressure in the central passage of the female connector and prevent hydraulic lock.

12. A wet mate electrical connector comprising:

A. a female connector comprising a female connector body defining a female seal end and a central passage extending through the female connector body, the central passage comprising a plurality of female contacts; and B. a male connector comprising:

i. a male connector body defining a male seal end and a central passage extending through the male connector body;

ii. a male pin axially projecting from the central passage of the male connector body, the male pin comprising a plurality of male contacts, the male pin being insertible into the central passage of the female connector; and iii. a sleeve slidably displaceable over the male pin between a first position in which the sleeve covers the plurality of male contacts in a protected condition, and a second position in which the sleeve is retracted and exposes the plurality of male contacts, wherein, upon insertion of the male pin into the central passage of the female connector, the sleeve on the male pin contacts the female seal end to displace the sleeve from the first position to the second position to expose the plurality of male contacts, the plurality of male contacts axially aligning with the plurality of female contacts in the female connector when the male pin is fully inserted or substantially inserted into the central passage of the female connector, wherein the female connector comprises a primary seal and a secondary seal to protect the plurality of female contacts, and wherein the primary seal comprises a plurality of spring energized seals arranged in series along the central passage.

13. The wet mate electrical connector of claim 12, wherein the plurality of female contacts are arranged in series with the plurality of spring energized seals along the central passage.

14. The wet mate electrical connector of claim 13, wherein each of the plurality of female contacts is separated by another of the plurality of female contacts by one of the plurality of spring energized seals.

* * * * *